US009989195B2

(12) United States Patent
Marinus et al.

(10) Patent No.: US 9,989,195 B2
(45) Date of Patent: Jun. 5, 2018

(54) ILLUMINATION DEVICE WITH FOLDED LIGHT SOURCE CARRIER AND METHOD OF ASSEMBLY

(71) Applicant: PHILIPS LIGHTING HOLDING B.V., Eindhoven (NL)

(72) Inventors: Antonius Adrianus Maria Marinus, Eindhoven (NL); Peter Johannes Martinus Bukkems, Deurne (NL); Simon Eme Kadijk, Veldhoven (NL); Vincent Stefan David Gielen, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 262 days.

(21) Appl. No.: 14/890,755

(22) PCT Filed: May 2, 2014

(86) PCT No.: PCT/EP2014/058962

§ 371 (c)(1),
(2) Date: Nov. 12, 2015

(87) PCT Pub. No.: WO2014/184008

PCT Pub. Date: Nov. 20, 2014

(65) Prior Publication Data

US 2016/0097490 A1 Apr. 7, 2016

(30) Foreign Application Priority Data

May 14, 2013 (EP) ..... 13167649

(51) Int. Cl.
*F21V 29/00* (2015.01)
*F21K 99/00* (2016.01)
(Continued)

(52) U.S. Cl.
CPC ..... *F21K 9/135* (2013.01); *F21K 9/23* (2016.08); *F21K 9/232* (2016.08); *F21K 9/238* (2016.08);
(Continued)

(58) Field of Classification Search
CPC .. F21V 19/0025; F21V 19/003; F21V 19/006; F21V 19/0065; F21V 29/503
See application file for complete search history.

(56) References Cited

U.S. PATENT DOCUMENTS 5,688,042 A * 11/1997 Madadi ..... F21V 3/00 362/240
6,621,222 B1 * 9/2003 Hong ..... F21V 3/02 315/272
(Continued)

FOREIGN PATENT DOCUMENTS

DE 202011108614 U1 1/2012
EP 2251584 A1 11/2010
(Continued)

*Primary Examiner* — Ismael Negron
(74) *Attorney, Agent, or Firm* — Akarsh P. Belagodu

(57) ABSTRACT

An illumination device includes a carrier, at least two light sources mounted on a first side of a carrier, and an envelope at least partially enclosing light sources and the carrier. At least one of the light sources is mounted on a portion of the carrier and at least another one of the light sources is mounted on a different portion of the carrier, and the carrier is folded such that the second side of the first portion of the carrier at least partially faces the second side of the second portion of the carrier.

20 Claims, 4 Drawing Sheets

(51) Int. Cl.

| | |
|---|---|
| ***F21K 9/90*** | (2016.01) |
| ***F21V 3/02*** | (2006.01) |
| ***F21V 23/00*** | (2015.01) |
| ***F21V 29/506*** | (2015.01) |
| ***F21V 29/70*** | (2015.01) |
| ***F21V 3/04*** | (2018.01) |
| ***F21K 9/23*** | (2016.01) |
| ***F21K 9/232*** | (2016.01) |
| ***F21K 9/238*** | (2016.01) |
| *F21Y 115/10* | (2016.01) |

(52) U.S. Cl.
CPC ..... *F21K 9/90* (2013.01); *F21V 3/02* (2013.01); *F21V 3/0409* (2013.01); *F21V 23/005* (2013.01); *F21V 29/20* (2013.01); *F21V 29/506* (2015.01); *F21V 29/70* (2015.01); *F21Y 2115/10* (2016.08)

(56) References Cited

U.S. PATENT DOCUMENTS

| | | | | |
|---|---|---|---|---|
| 6,827,469 | B2 * | 12/2004 | Coushaine | F21K 9/232 362/249.06 |
| 7,396,142 | B2 | 7/2008 | Laizure, Jr. et al. | |
| 7,690,813 | B2 * | 4/2010 | Kanamori | F21K 9/60 361/704 |
| 8,272,762 | B2 * | 9/2012 | Maxik | F21K 9/90 362/249.02 |
| 8,545,056 | B2 * | 10/2013 | Kajiya | H05K 1/147 257/98 |
| 8,596,821 | B2 * | 12/2013 | Brandes | F21K 9/238 362/249.01 |
| 2005/0174769 | A1 * | 8/2005 | Yong | F21V 3/02 362/235 |
| 2005/0254264 | A1 * | 11/2005 | Sidwell | F21V 3/00 362/655 |
| 2006/0193130 | A1 * | 8/2006 | Ishibashi | F21V 29/67 362/227 |
| 2009/0103295 | A1 * | 4/2009 | Wang | F21K 9/00 362/234 |
| 2010/0148984 | A1 * | 6/2010 | Chien | F21K 9/00 362/85 |
| 2011/0163683 | A1 | 7/2011 | Steele et al. | |
| 2012/0033407 | A1 * | 2/2012 | Barta | F21V 23/005 362/95 |
| 2012/0069570 | A1 | 3/2012 | Marinus et al. | |
| 2012/0243230 | A1 | 9/2012 | Carroll et al. | |

FOREIGN PATENT DOCUMENTS

| | | | |
|---|---|---|---|
| WO | 2005090852 | A1 | 9/2005 |
| WO | 2010058325 | A1 | 5/2010 |
| WO | 2010131166 | A1 | 11/2010 |
| WO | WO2010136950 | A1 | 12/2010 |
| WO | 2012095758 | A2 | 7/2012 |

* cited by examiner

ILLUMINATION DEVICE WITH FOLDED LIGHT SOURCE CARRIER AND METHOD OF ASSEMBLY

CROSS-REFERENCE TO PRIOR APPLICATIONS

This application is the U.S. National Phase application under 35 U.S.C. § 371 of International Application No. PCT/EP2014/058962, filed on May 2, 2014, which claims the benefit of European Patent Application No. 13167649.6, filed on May 14, 2013. These applications are hereby incorporated by reference herein.

FIELD OF THE INVENTION

The present invention generally relates to field of lighting. Specifically, the present invention relates to an illumination device comprising light sources, a carrier and an envelope, to a method of manufacturing the illumination device, and to a luminaire comprising such an illumination device.

BACKGROUND OF THE INVENTION

Illumination devices having the appearance of providing omnidirectional illumination are of interest for various lighting purposes, including applications such as lighting in homes, hospitals and offices, etc., outdoor lighting, and illumination of entertainment and industry spaces.

In for example US 2012/0069570, a LED lamp is disclosed, wherein the illumination device is divided in two compartments by a first and a second carrier arranged to support light sources distributed on each side of the first and second carriers in order to provide a uniform light distribution.

Although such an illumination device may provide a uniform light distribution, there is still a need for a device being relatively easy to assemble and yet able to emit light in a wide range of directions, i.e. having the appearance of providing omnidirectional illumination.

SUMMARY OF THE INVENTION

In view of the above discussion, a concern of the present invention to provide an illumination device capable of or having the appearance of providing omnidirectional illumination. A further concern of the present invention is to provide an illumination device which can be assembled with relative ease.

To address at least one of these concerns and other concerns, an illumination device and a method of manufacturing an illumination device in accordance with the independent claims are provided. Preferred embodiments are defined by the dependent claims.

According to a first aspect of the invention, there is provided an illumination device comprising at least two light sources, each of which is arranged to emit light, and a carrier having a first and a second side. The at least two light sources are coupled to the first side of the carrier, which carrier and light sources are at least partially enclosed by an envelope. At least one of the light sources is coupled to a first portion of the carrier and at least another one of the light sources is coupled to a second portion of the carrier, wherein the first and second portions of the carrier are different. The carrier is arranged such that the second side of the first portion of the carrier at least partially faces the second side of the second portion of the carrier, or vice versa.

Hence, in alternative the carrier may be arranged such that the second side of the second portion of the carrier at least partially faces the second side of the first portion of the carrier.

According to a second aspect of the present invention, there is provided a luminaire comprising the illumination device according to the first aspect of the invention.

According to a third aspect of the present invention, there is provided a method of manufacturing an illumination device. The method comprises providing at least two light sources, each of which is arranged to emit light, providing a carrier having a first side and a second side, and coupling the at least two light sources to the first side of the carrier. At least one of the light sources is coupled to a first portion of the carrier and at least another of the light sources is coupled to a second portion of the carrier, wherein the first and second portions of the carrier are different. The method comprises providing an envelope arranged to at least partially enclose the light sources and the carrier, and arranging the carrier such that the second side of the first portion of the carrier at last partially faces the second side of the second portion of the carrier, or vice versa.

Embodiments of the present invention are based on a realization that by folding or bending the carrier, light sources mounted on the carrier may be directed to emit light in several directions, or even omnidirectional or substantially omnidirectional, while still being mounted on a single side of a single carrier. Thereby the manufacturing process of the illumination device may be simplified in terms of a reduced bill-of-material and facilitated assembly.

The carrier may comprise e.g. a printed circuit board (PCB), which may provide mechanical support and electrical connections to the light sources. In alternative or in addition, the carrier may comprise a leadframe. The PCB may be divided into a first and a second portion, which are electrically connected to each other and provided with light sources. The carrier may comprise a flexible PCB which advantageously allows the carrier to readily conform to a desired shape. The carrier may be formed into the desired shape after the assemblage of the light sources, thereby e.g. allowing for the light sources and possibly other components to be mounted on a flat surface. Thereby, components may be mounted on one side only of a single flat or substantially flat carrier, which advantageously enables a facilitated manufacturing.

The carrier may comprise a material having a relatively high thermal conductivity to enable a good heat performance, or cooling, of the light sources. The carrier may comprise a light reflecting region arranged to reflect at least part of the light generated by the light sources, and/or a light transmitting region arranged to transmit at least part of the light generated by the light sources.

It should be noted that the term "different" in regard to the first and second portions of the carrier should be understood as the first and second portions of the carrier forming different regions of the carrier, and not necessarily as the shape and/or design of the respective portions being different.

In the context of the present application, the term "light source" is used to define substantially any device or element that is capable of emitting radiation in any region or combination of regions of the electromagnetic spectrum, for example the visible region, the infrared region, and/or the ultraviolet region, when activated e.g. by applying a potential difference across it or passing a current through it. Therefore a light source can have monochromatic, quasi-monochromatic, polychromatic or broadband spectral emission characteristics. Examples of light sources include semiconductor, organic, or polymer/polymeric light-emitting diodes (LEDs), blue LEDs, optically pumped phosphor coated LEDs, optically pumped nano-crystal LEDs or any other similar devices as would be readily understood by a person skilled in the art. RGB LEDs may advantageously be used to enable dynamic color light output from the illumination device. Furthermore, the term light source can be used to define a combination of the specific light source that emits the radiation in combination with a housing or package within which the specific light source or light sources are placed. For example, the term light source may comprise a bare LED die arranged in a housing, which may be referred to as a LED package.

The light sources may be provided on the carrier such that an electrical connection is provided between the carrier and the light sources. Preferably, the light sources are mechanically fixed, or coupled, to the carrier for example by soldering, electrically conductive gluing, welding, clinching, or any other technique readily understood by a person skilled in the art. Any one of the light sources may be directly or indirectly coupled to the first side of the carrier.

A light source, such as e.g. a LED, arranged on a first surface of a first portion of the carrier, may emit light along or substantially along a direction parallel with a normal of the first surface. In case the carrier does not allow transmission of light therethrough, or only allows a relatively small amount of light therethrough, the light source coupled to the first surface of the carrier may however not be able to emit light along or substantially along a direction opposite to the normal of the first surface (or may only be able to emit a relatively small amount of light along or substantially along a direction opposite to the normal of the first surface). However, by coupling at least one light source to a first portion of the carrier and at least one another light source to a second portion of the carrier, and bending, or folding, the carrier such that the first and second portions of the carrier no longer share a common plane, the light generated by the light sources may be emitted in more directions than the light emitted by the light sources in case the carrier is not bent or folded. The carrier may for example be arranged such that the second side of the first portion of the carrier and the second side of the second portion of the carrier are parallel, which advantageously may enable light to be emitted from the illumination device in essentially all directions, or at least enable achieving an impression of omnidirectional illumination by the illumination device. In the context of the present application, the term "parallel" should be understood not necessarily as absolutely parallel but that an angle between a normal of the second side of the first portion of the carrier and a normal of the second side of the second portion of the carrier may be within a certain angle interval, e.g. within an interval between 170° and 190°, or even a larger angle interval about 180°.

Bending or folding the carrier to increase the angle interval of the light emitted by the illumination device may enable the use of a single sided carrier, e.g. a PCB, having components such as e.g. light sources mounted on only one side of the carrier, which may facilitate handling and assemblage during the manufacturing of the illumination device. Bending or folding the carrier to increase the angle interval of the light emitted by the illumination device may enable the use of a single carrier only, which carrier has components such as e.g. light sources coupled to the carrier, which in turn advantageously may allow for a reduced number of components in the illumination device.

The envelope, at least partially enclosing the carrier and the light sources, may comprise a material that provides electrical isolation and/or mechanical protection of the enclosed carrier and light sources. Such materials may for example be selected from ceramics, glass, plastics, and/or paper. Ceramic poly crystalline alumina is an example of an advantageous material for high lumen output devices due to its mechanical strength, relatively high thermal conductivity, electrical insulation, light reflection and light transmission properties, and its ability of being formed into various kinds of shapes. Glass, plastics and paper may be advantageous for e.g. low lumen output devices due to the relatively low cost of these materials.

The envelope may comprise a light transmitting region arranged to at least partly allow transmission of at least part of the light emitted by the light source through the light transmitting region. The light transmitting region may be translucent, so as to prevent a user from perceiving the light sources and optional electronics within the envelope, or transparent. The envelope may comprise a reflective region arranged to reflect at least part of the light emitted by the light sources impinging on the reflective region.

The envelope may have the shape of a bulb, or lamp bulb, which may be mounted on a socket assembly. This advantageously allows for a retrofit illumination device that may be installed in various types of luminaires.

The socket assembly may be referred to as the base of the illumination device, while the opposing portion of the envelope may be referred to as the top of the illumination device. An axis may extend from the base of the illumination device to its top, defining the longitudinal axis of the illumination device.

According to an embodiment of the present invention, at least a portion of the carrier is aligned with the longitudinal axis of the illumination device, which may improve the symmetry of the illumination.

According to an embodiment of the present invention, the illumination device comprises a thermal conductor arranged to thermally connect the carrier with at least a portion of the envelope so as to enable heat to be dissipated from the illumination device via the envelope. The thermal conductor preferably comprises a material having good thermal conductivity so as to enable efficient heat transfer. Examples of such a material may include a metal, such as e.g. copper, aluminum, nickel, and brass; a ceramic; a glass; and/or another suitable material readily known by a person skilled in the art. The thermal conductivity of the thermal conductor, and hence the thermal performance, may be affected by the thickness and the shape of the thermal conductor. The thermal conductor may for example comprise a metal strip which is thermally connected to the carrier and a portion of the inner surface of the envelope. In alternative or in addition, the thermal conductor may comprise a heat pipe strip, such as e.g. an MTRAN® (Micro Flat Heat Transmitter) supplied by COOLT™.

The thermal performance of the illumination device may be improved by increasing the thermal contact area between the envelope and the thermal conductor. This may for example be achieved by arranging a portion of the thermal conductor as a metal strip applied to the inner surface of the envelope. The metal strip may e.g. extend along a path from the base to the top of the envelope, or extend along a path perpendicular to the longitudinal axis. A thermal interface material (TIM) may be applied to improve the thermal contact between the thermal conductor, the carrier, and/or the envelope. The efficiency of the heat dissipation may be adapted to various applications depending on e.g. the amount of generated heat and the optical performance. As an example, high lumen devices generating a relatively large amount of heat might require a relatively high degree of heat dissipation. This may be addressed for example by increasing the size of a thermal contact area between the thermal conductor and the envelope. Low lumen devices, generating less heat, might hence require a smaller thermal contact area. By reducing the size of the thermal contact area between the thermal conductor and the envelope, the visual appearance may be improved due to less shadowing of the envelope caused by the thermal conductor. The thermal conductor may be hidden by an applied print, such as e.g. silver, on the outer surface of the envelope in order to improve the visual appearance of the illumination device.

According to an embodiment of the present invention, the envelope comprises at least two enveloping parts which, when joined together, form the envelope. A portion of the thermal conductor may be arranged at a junction between the envelope parts, in thermal contact with the surroundings of the illumination device, which advantageously enables heat to be dissipated from the illumination device via the portion of the thermal conductor.

According to an embodiment of the present invention, the method of manufacturing the illumination device comprises arranging a thermal conductor to thermally connect the carrier with at least a portion of the envelope so as to enable heat to be dissipated from the illumination device via the envelope.

According to an embodiment of the present invention, the envelope is formed of at least two enveloping parts, wherein a portion of the thermal conductor is arranged at a junction between the enveloping parts in thermal contact with the surroundings of the illumination device so as to enable heat to be dissipated from the illumination device via the portion of the thermal conductor. The envelope may comprise a material selected from ceramics, glass, plastics, and/or paper.

According to an embodiment of the present invention, at least one driver circuit is coupled to at least one of the first and second portions of the carrier, wherein the at least one driver circuit is adapted to supply current to at least one of the light sources.

It is noted that the invention relates to all possible combinations of features recited in the claims.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, in which.

All the figures are schematic, not necessarily to scale, and generally only show parts which are necessary in order to elucidate the embodiments of the present invention, wherein other parts may be omitted or merely suggested.

DETAILED DESCRIPTION

The present invention will now be described more fully hereinafter with reference to the accompanying drawings, in which exemplifying embodiments of the present invention are shown. The present invention may, however, be embodied in many different forms and should not be construed as limited to the embodiments set forth herein; rather, these embodiments are provided by way of example so that this disclosure will convey the scope of the invention to those skilled in the art. The steps of any method described herein do not have to be performed in the exact order as described, unless specifically stated. Furthermore, like numbers refer to the same or similar elements or components throughout.

Figure 1:
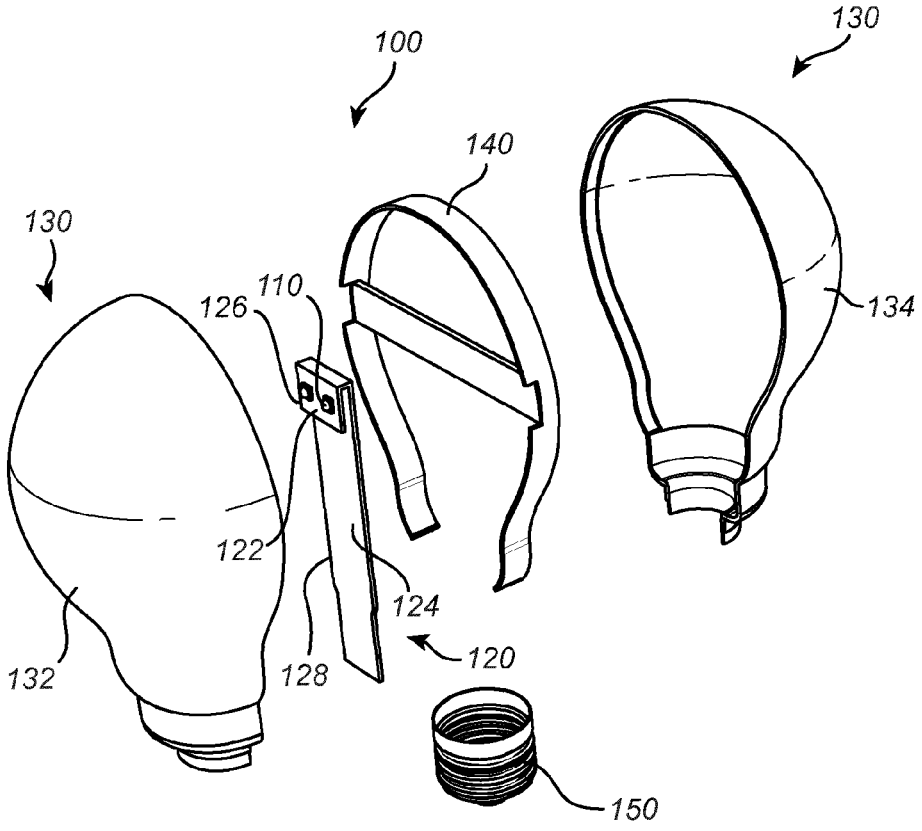
FIG. 1 schematically depicts an exploded perspective view of an illumination device according to an embodiment of the present invention, comprising light sources coupled to a folded carrier.

In FIG. 1, a retrofit illumination device 100, arranged to generate output light having the appearance of being omnidirectional, is schematically depicted according to an embodiment of the present invention. The illumination device 100 comprises four light sources 110 (only two shown in FIG. 1) coupled to a carrier 120 having a first side 122 and a second side 124, wherein the light sources 110 are coupled to the first side 122 of the carrier 120. According to this embodiment, two of the light sources 110 are coupled to a first portion 126 of the carrier 120, and the other two light sources 110 (not shown) are coupled to second portion 128 of the carrier 120.

The light sources 110 may in principle comprise any kind of light source 110 that is able to generate and emit light. For example, the light sources 110 may comprise light emitting diodes, LEDs. RGB LEDs are advantageously used to enable dynamic color light output from the illumination device 100. The light sources 110 shown in FIG. 1 may be of the same type or different types. The number of light sources 110 in FIG. 1 is according to a non-limiting example. According to other embodiments of the present invention, one light source 110 may be coupled to each of the first side 122 and the second side 124. In general, at least one light source 110 is coupled to the first side 122 and at least one light source 110 is coupled to the second side 124.

The carrier 120 may comprise any kind of structure, such as e.g. a printed circuit board (PCB), which electrically connects the light sources 110 and provides them with mechanical support. The carrier 120 comprises at least a first portion 126 and a second portion 128 which are electrically connected. In general, the first portion 126 and the second portion 128 are arranged such that the second side 124 of the first portion 126 at least partially faces the second side 124 of the second portion 128, or vice versa. According to the embodiment as depicted in FIG. 1, the carrier 120 is bent such that the second side 124 of the first portion 126 of the carrier 120 and the second side 124 of the second portion 128 of the carrier 120 are parallel or substantially parallel. However, it is not necessary that the second side 124 of the first portion 126 of the carrier 120 and the second side 124 of the second portion 128 of the carrier 120 are parallel or substantially parallel. Rather, the carrier 120 may in general be bent or folded such that a normal vector of the second side 124 of the first portion 126 of the carrier 120 and a normal vector of the second side 124 of the second portion 128 of the carrier 120 are pointing in different directions. Light emitted by the light sources 110 coupled to the first side 122 of the first portion 126 of the carrier 120 is emitted along or substantially along a direction parallel to a normal of the first side 122 of the first portion 126 of the carrier 120, and light emitted by the light sources 110 coupled to the first side 122 of the second portion 128 of the carrier 120 is emitted along or substantially along a direction parallel to a normal of the first side 122 of the second portion 128 of the carrier 120, which may enhance the capacity or impression of omnidirectional illumination by the illumination device 100.

The thermal conductor 140 shown in FIG. 1 may for example comprise two metal strips arranged in thermal contact with the carrier 120 and a portion of the inner surface of the envelope 130, thereby achieving a thermal connection between the carrier 120 and the envelope 130. A thermal interface material (TIM) may be applied to the thermal contact areas of the carrier 120 and the envelope 130, respectively, in order to increase the efficiency of the heat dissipation. The thermal conductor 140 may in addition or in alternative comprise other kinds of materials that may enable a good thermal performance, such as e.g. metal alloys and ceramics. The shape and thermal contact areas of the thermal conductor 140 may be modified in order to adapt the efficiency of the heat dissipation to various applications, such as e.g. low lumen output devices and high lumen output devices.

The envelope 130 may in principle comprise any kind of material that is able of provide the illumination device 100 with mechanical protection, electrical isolation, and/or dissipation of heat. The envelope 130 may be able to transmit at least part of the light emitted by the light sources 110. According to the embodiment depicted in FIG. 1, the envelope 130 may comprise two enveloping parts 132, 134 of e.g. glass which, when joined together, form a bulb-shaped envelope 130. The enveloping parts 132, 134 may be joined together by e.g. gluing, welding, clinching, or any other suitable technique readily understood by a person skilled in the art. It will be realized that the envelope 130 in addition or in alternative may comprise other materials such as e.g. ceramics, plastics, and/or paper, formed in one or several pieces.

As the two enveloping parts 132, 134 are joined together, the envelope 130 may enclose the carrier 120, the light sources 110, and the thermal conductor 140. The envelope 130 and the carrier 120 may be fixated in a socket assembly 150 forming a base of the illumination device 100. The socket assembly 150 may provide the illumination device 100 with mechanical support and electrical power, and may be formed to fit any kind of available lighting fixtures.

During operation, electrical power is supplied to the light sources 110 which may generate light and heat energy. The heat energy is transferred to the carrier 120 and dissipated through the envelope 130 via the thermal conductor 140 which is in thermal contact with the carrier 120 and the envelope 130. The light that is emitted by the light sources 110 may be transmitted through the envelope 130 in a wide range of directions, such that the illumination provided by the illumination device 100 appears to a viewer to be omnidirectional, or even such that omnidirectional or substantially omnidirectional illumination by the illumination device 100 is achieved.

Figure 2A:
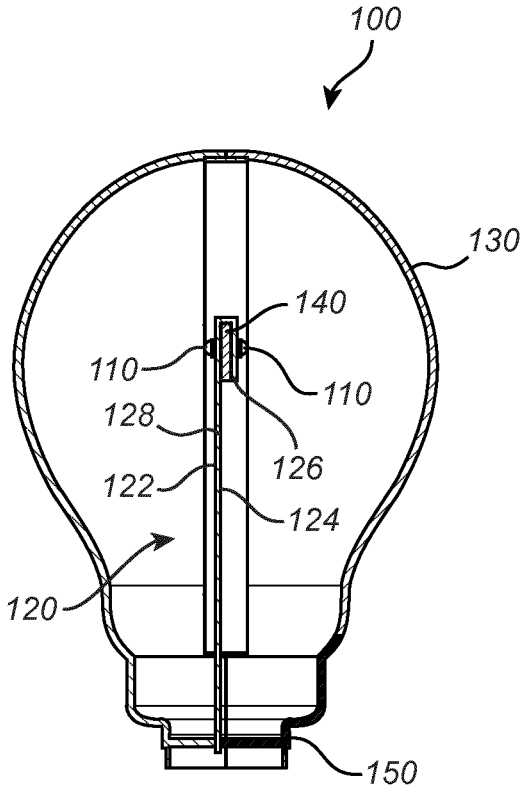
FIG. 2*a* schematically depicts a cross sectional side view of an illumination device according to another embodiment of the present invention.

With reference to FIG. 2*a* there is shown a schematic cross sectional side view of an illumination device 100 according to an embodiment of the present invention, comprising an envelope 130 and a carrier 120 mounted in a base in the form of a socket assembly 150. The carrier 120 has a first side 122, a second side 124, a first portion 126, and a second portion 128. Light sources 110 are coupled to the first side 122 of the first portion 126 and the first side 122 of the second portion 128, respectively. According to the embodiment depicted in FIG. 2*a*, the first portion 126 and the second portion 128 are electrically connected, and arranged such that the second side 124 of the second portion 128 faces the second side 124 of the first portion 126, and the carrier 120 is bent or folded such that the second side 124 of the first portion 126 of the carrier 120 and the second side 124 of the second portion 128 of the carrier 120 are parallel or substantially parallel. However, it is not necessary that the second side 124 of the first portion 126 of the carrier 120 and the second side 124 of the second portion 128 of the carrier 120 are parallel or substantially parallel. Rather, the carrier 120 may in general be bent or folded such that a normal vector of the second side 124 of the first portion 126 of the carrier 120 and a normal vector of the second side 124 of the second portion 128 of the carrier 120 are pointing in different directions. Light emitted by the light source 110 coupled to the first side 122 of the first portion 126 of the carrier 120 is emitted along or substantially along a direction parallel to the normal of the first side 122 of the first portion 126 of the carrier 120, and light emitted by the light source 110 coupled to the first side 122 of the second portion 128 of the carrier 120 is emitted along or substantially along a direction parallel to the normal of the first side 122 of the second portion 128 of the carrier 120, which may enhance the capacity or impression of omnidirectional illumination by the illumination device 100. The illumination device 100 may comprise a thermal conductor 140 for enabling heat to be dissipated from the illumination device 100.

Figure 2B:
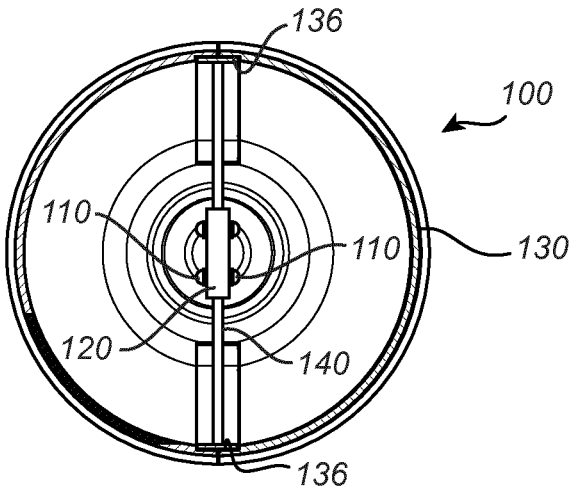
FIG. 2*b* schematically depicts a cross sectional top view of a similar illumination device.

FIG. 2*b* is a schematic cross sectional top view of an illumination device 100 similar to the illumination device 100 depicted in FIG. 2*a*. The illumination device 100 depicted in FIG. 2*b* comprises an envelope 130, a carrier 120, and light sources 110 coupled to the carrier 120. The function and/or operation of the light sources 110 and carrier 120 are similar to or the same as the function and operation, respectively, of the light sources 110 and carrier 120 in the illumination device 100 described with reference to FIG. 2*a*. According to the embodiment depicted in FIG. 2*b*, the illumination device 100 comprises a thermal conductor 140 which thermally connects the carrier 120 with at least a portion of the envelope 130 so as to enable heat to be dissipated from the illumination device 100 via the envelope 130. The thermal conductor 140 comprises a metal strip arranged in thermal contact with portions 136 of the inner surface of the envelope 130 to enable a relatively good thermal coupling between the carrier 120 and the envelope 130, which may improve the efficiency and/or capacity in dissipation of heat from the illumination device 100.

Figure 3A:
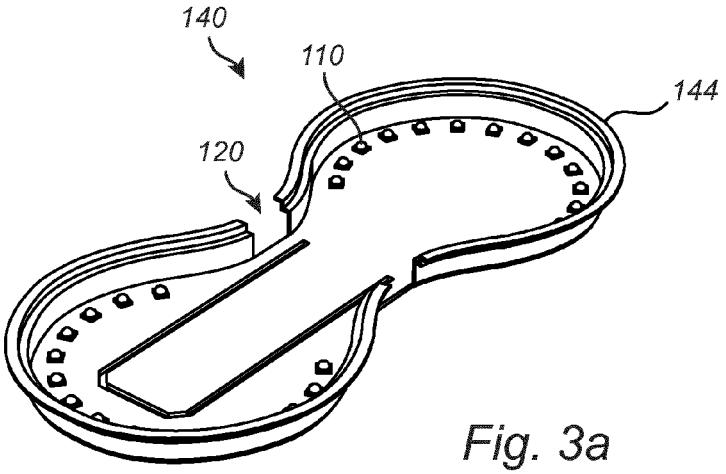
FIG. 3*a* schematically depicts a perspective view of a carrier prior to it being folded.

With reference to FIG. 3*a* there is shown a schematic perspective view of a flat carrier 120 prior to it being folded and arranged in the illumination device. Light sources 110 are mounted on a first side of the carrier, and a thermal conductor 140, of which only a portion 144 is shown in FIG. 3*a*, is arranged in thermal contact with a second side of the carrier so as to enable heat to be dissipated from the carrier via the portion 144 of the thermal conductor.

Figure 3B:
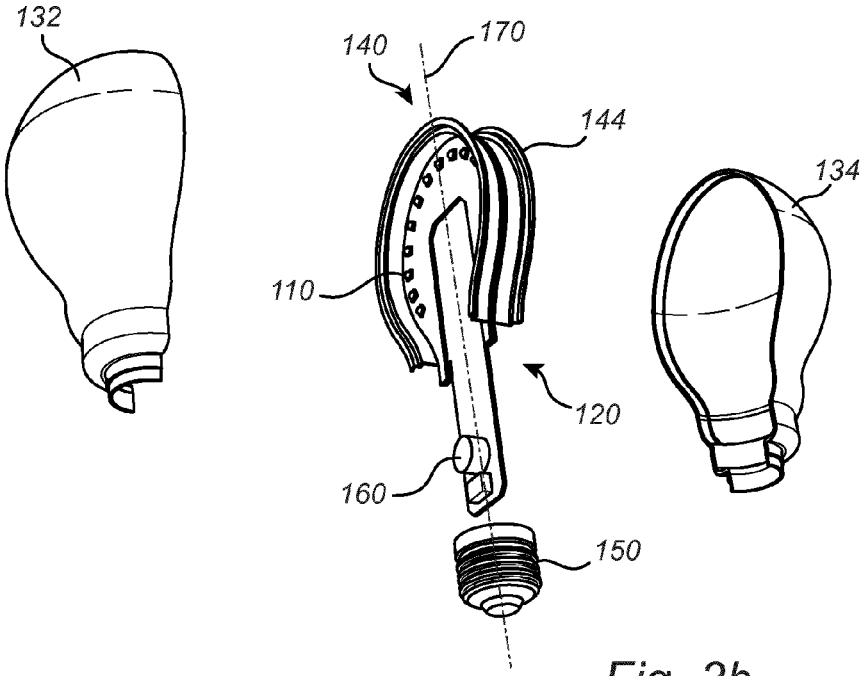
FIG. 3*b* schematically depicts an exploded perspective view an illumination device according to an embodiment of the present invention.

In FIG. 3*b* there is shown an exploded perspective view of an illumination device 100 according to an embodiment of the present invention, comprising light sources 110 coupled to a folded carrier 120 (similar to the carrier 120 depicted in FIG. 3*a*) and an envelope 130 at least partly enclosing the carrier 120 and the light sources 110. The carrier 120 and the envelope 130 are fixated to a socket assembly 150, and a thermal conductor 140 is arranged in thermal contact with the carrier 120 and the envelope 130 to dissipate heat generated by the light sources 110.

The light sources 110, which e.g. may comprise LEDs, are coupled to the first surface of the carrier 120 which is divided into a first portion 126 and a second portion 128 (not shown in FIG. 3*b*). The light sources 110, e.g. LEDs, are coupled to both the first and the second portion 128 of the carrier 120, which may comprise e.g. a flexible PCB and is folded such that the second surface of the first portion 126 and the second surface of the second portion 128 at least partially face each other to enable light to be emitted substantially in opposite directions. The first portion 126 of the carrier 120 is provided with a driver circuit 160 for supplying electrical current to the carrier 120 and hence the light sources 110, e.g. LEDs. The socket assembly 150, to which the carrier 120 is fixated, forms a base of the illumination device 100, and may, according to this embodiment, be aligned with a longitudinal axis 170 extending from the base towards the opposing top of the illumination device 100.

The thermal conductor 140 may e.g. be formed of a metal sheet. A portion 144 of the thermal conductor 140 may be arranged at a junction between the two enveloping parts 132, 134 of the envelope 130. Thereby the portion of the thermal conductor 140 may be in thermal contact both with the envelope 130 and the surroundings. The thermal conductor 140 may also be arranged to mechanically support the carrier 120 by for example being attached to the second surface of the first and second portions 126, 128 of the carrier 120. Thereby the thermal conductor 140 may enable heat to be dissipated from the carrier 120 and at the same time keep the carrier 120 in its position aligned with the longitudinal axis of the illumination device 100.

Figure 4:
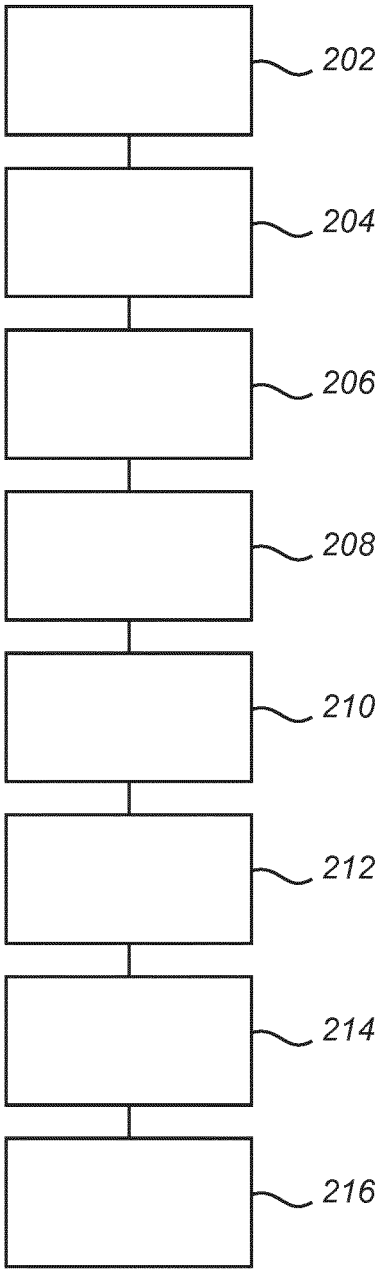
FIG. 4 is a schematic flowchart of a method of manufacturing an illumination device according to an embodiment of the present invention.

With reference to FIG. 4, there is shown a schematic flowchart of a method of manufacturing an illumination device 100 according to an embodiment of the present invention. The method comprises providing 202 at least two light sources 110, providing 204 a carrier 120, having a first side 122 and a second side 124, and coupling 206 the at least two light sources 110 to the first side 122 of the carrier 120 by e.g. a surface mounting technique. At least one of the light sources 110 is coupled to a first portion 126 of the carrier 120 and at least another of the light sources 110 is coupled to a second portion 128 of the carrier 120. The method comprises the steps of providing 208 an envelope 130 arranged to at least partially enclose the light sources 110 and the carrier 120, e.g. when the illumination device 100 is assembled and/or in user, and arranging 210 the carrier 120 such that the second side 124 of the first portion 126 of the carrier 120 at least partially faces the second side 124 of the second portion 128 of the carrier 120, or vice versa.

A thermal conductor 140 may be arranged 212 to thermally connect the carrier 120 with at last a portion of the envelope 130. Thereby heat, generated by the light sources 110 during operation of the illumination device 100, is enabled to be dissipated from the illumination device 100 via the envelope 130. The thermal conductor 140 may be arranged 214 such that a portion of the thermal conductor 140 is arranged at a junction between the two enveloping parts 132, 134, in thermal contact with both the envelope 130 and the surroundings of the illumination device 100, so as to enable heat to be dissipated from the illumination device 100 via the portion of the thermal conductor 140.

At least one driver may be coupled 216 to at least one of the first and second portions 126, 128 of the carrier 120 for supplying electrical power to the light sources 110, for example by directly supplying electrical power to the light sources 110 or indirectly, e.g. via electrical couplings or current paths in or on the carrier 120.

Any one of steps 212, 214 and 216 is optional.

In conclusion, an illumination device is disclosed, comprising at least two light sources, each of which is arranged to emit light, a carrier having a first side and a second side, wherein the at least two light sources are coupled to the first side of the carrier, and an envelope at least partially enclosing the light sources and the carrier. At least one of the light sources is coupled to a first portion of the carrier and at least another one of the light sources is coupled to a second portion of the carrier, wherein the first and second portions of the carrier are different, and the carrier is arranged such that the second side of the first portion of the carrier at least partially faces the second side of the second portion of the carrier. Thereby the light sources may be directed to emit light in several directions so as to increase the angle interval of the light emitted by the illumination device with the light sources being mounted e.g. on a single side of a single carrier, which may enable a reduced number of components and facilitated assembly. A luminaire comprising the illumination device, and a method of manufacturing such a device, are also disclosed.

The person skilled in the art realizes that the present invention by no means is limited to the preferred embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. An illumination device, comprising:

at least two light sources arranged to emit light;

a carrier, having a first side and a second side, wherein the at least two light sources are coupled to the first side of the carrier;

an envelope comprising at least two enveloping parts that are joined together to form the envelope, which at least partially encloses the at least two light sources and the carrier; and a thermal conductor arranged in thermal contact with the second side of the carrier, at least a portion of the envelope, and both an inner surface and an outer surface of at least one enveloping part of the at least two enveloping parts, enabling heat to be dissipated via the thermal conductor, wherein the thermal conductor is further arranged at a junction between at least two of the enveloping parts;

wherein a light source of the at least two light sources is coupled to a first portion of the carrier and another light source of the at least two light sources is coupled to a second portion of the carrier, wherein the first portion and the second portion of the carrier each form different regions of the carrier, and wherein the carrier is folded such that: the second side of the first portion of the carrier at least partially faces the second side of the second portion of the carrier, and the thermal conductor is arranged between the first portion of the carrier and the second portion of the carrier.

2. The illumination device according to claim 1, wherein the envelope comprises ceramic, glass, plastic, or paper.

3. The illumination device according to claim 1, further comprising:

at least one driver circuit that is coupled to the first portion or the second portion of the carrier, wherein the at least one driver circuit is adapted to supply current to at least one light source of the light sources.

4. The illumination device according to claim 1, wherein the carrier is arranged such that the second side of the first portion of the carrier and the second side of the second portion of the carrier are parallel.

5. The illumination device according to claim 1, wherein the carrier is a printed circuit board or a lead frame.

6. The illumination device according to claim 1, wherein the first portion or the second portion of the carrier is aligned with a longitudinal axis extending from a base of the illumination device.

7. The illumination device according to claim 1, wherein the envelope comprises a reflective region arranged to reflect at least part of the light emitted by the light sources.

8. The illumination device according to claim 1, wherein the thermal conductor comprises one or more metal strips.

9. The illumination device according to claim 1, wherein the thermal conductor comprises one or more heat pipe strips.

10. The illumination device according to claim 1, wherein the envelope and carrier are fixated in a socket assembly.

11. A system, comprising:

at least two light sources arranged to emit light;

a carrier, having a first side and a second side, wherein the at least two light sources are coupled to the first side of the carrier;

an envelope comprising at least two enveloping parts that are joined together to form the envelope, which at least partially encloses the at least two light sources and the carrier; and a thermal conductor arranged in thermal contact with the second side of the carrier, at least a portion of the envelope, and both an inner surface and an outer surface of at least one enveloping part of the at least two enveloping parts, enabling heat to be dissipated via the portion of the thermal conductor, wherein the thermal conductor is further arranged at a junction between at least two of the enveloping parts;

wherein a light source of the at least two light sources is coupled to a first portion of the carrier and another light source of the light sources is coupled to a second portion of the carrier, wherein the first portion and the second portion of the carrier each form different regions of the carrier, and wherein the carrier is folded such that: the second side of the first portion of the carrier at least partially faces the second side of the second portion of the carrier, and the thermal conductor is arranged between the first portion of the carrier and the second portion of the carrier.

12. The system according to claim 11, wherein the thermal conductor comprises one or more metal strips.

13. The system according to claim 11, wherein the thermal conductor comprises one or more heat pipe strips.

14. The system according to claim 11, wherein the envelope and carrier are fixated in a socket assembly.

15. The system according to claim 11, wherein the envelope comprises ceramic, glass, plastic, or paper.

16. A method of manufacturing an illumination device, the method comprising:

providing at least two light sources;

providing a carrier, having a first side and a second side;

coupling the at least two light sources to the first side of the carrier such that at least one of the light sources is coupled to a first portion of the carrier and at least another of the light sources is coupled to a second portion of the carrier, wherein the first portion and second portion of the carrier each form different regions of the carrier, providing an envelope that includes at least two enveloping parts that are joined together to form the envelope, which is arranged to at least partially enclose the at least two light sources and the carrier;

arranging a thermal conductor to be in thermal contact with the second side of the carrier, at least a portion of the envelope, and both an inner surface and an outer surface of at least one enveloping part of the at least two enveloping parts enabling heat to be dissipated via the thermal conductor, wherein the thermal conductor is further arranged at a junction between the at least two enveloping parts; and folding the carrier such that: the second side of the first portion of the carrier at least partially faces the second side of the second portion of the carrier, and the thermal conductor is arranged between the first portion of the carrier and the second portion of the carrier.

17. The method according to claim 16, wherein the envelope comprises ceramic, glass, plastic, or paper.

18. The method according to claim 16, further comprising coupling at least one driver circuit to the first portion or the second portion of the carrier, wherein the at least one driver circuit is adapted to supply current to at least one of the light sources.

19. The method according to claim 16, further comprising:

arranging a reflective region of the envelope to reflect at least part of the light emitted by the light sources.

20. The method according to claim 16, further comprising:

arranging the carrier and the envelope in a socket assembly.

* * * * *